US007194969B2

(12) United States Patent
Niizeki et al.

(10) Patent No.: US 7,194,969 B2
(45) Date of Patent: Mar. 27, 2007

(54) NEEDLE PLATE

(75) Inventors: Tomoyasu Niizeki, Nagoya (JP); Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/376,148

(22) Filed: Mar. 16, 2006

(65) Prior Publication Data

US 2006/0213410 A1 Sep. 28, 2006

(30) Foreign Application Priority Data

Mar. 23, 2005 (JP) ..... 2005-083966

(51) Int. Cl.
*D05V 73/12* (2006.01)
*D05B 73/00* (2006.01)

(52) U.S. Cl. ..... 112/260

(58) Field of Classification Search ..... 112/258, 112/259, 260, 181, 217.1
See application file for complete search history.

(56) References Cited

U.S. PATENT DOCUMENTS 863,491 A * 8/1907 Ammerman ..... 112/260
1,262,114 A * 4/1918 Smallbone ..... 112/260
3,131,660 A * 5/1964 Noboru ..... 112/260
4,395,962 A * 8/1983 Odermann ..... 112/260
4,694,763 A * 9/1987 Adams ..... 112/184
7,021,226 B2 * 4/2006 Tseng ..... 112/302

FOREIGN PATENT DOCUMENTS

JP A 2002-336579 11/2002

* cited by examiner

*Primary Examiner*—Ismael Izaguirre
(74) *Attorney, Agent, or Firm*—Oliff & Berridge, PLC

(57) ABSTRACT

A needle plate includes a first needle plate fixed to a sewing machine bed and having a needle hole through which a sewing needle is penetratable and a square hole through which a feed dog for feeding a workpiece cloth is projected and retracted; a second needle plate positioned in front of the first needle plate and above a horizontal hook mechanism and detachably attached to the first needle plate; an engagement mechanisms in which the second needle plate is slid into engagement with the first needle plate; and a disengagement mechanism for disengagement of the engagement mechanisms.

11 Claims, 6 Drawing Sheets

NEEDLE PLATE

CROSS-REFERENCE TO RELATED APPLICATIONS

This application is based upon and claims the benefit of priority from the prior Japanese Patent Application No. 2005-083966, filed on, Mar. 23, 2005 the entire contents of which are incorporated herein by reference.

TECHNICAL FIELD

The present disclosure relates to a needle plate for a sewing machine placed on the upper surface of a sewing machine bed having a horizontal hook mechanism therein.

BACKGROUND

As disclosed in JP-A-2002-336579, conventional household sewing machines have been used in which a needle plate is constructed by a first needle plate fixed to a sewing machine bed and a second needle plate (referred to as a first lid in the above disclosure) detachably attached to the sewing machine bed. The first needle plate is formed in an oblong shape and is made of a metal plate (steel plate) having a needle hole for penetration of sewing needle therethrough and a square hole for projecting and retracting a feed dog for feeding a workpiece cloth. The second needle plate is formed in an L-shape and is located along the left and front side of the first needle plate. The first needle plate is made of metal so as to tolerate the striking of the sewing needle thereon. The second needle plate, on the other hand, merely supports a cloth on the upper surface thereof and is not struck by the sewing needle. Hence, the second needle plate is made of synthetic resin for cost reduction.

The following construction is adopted to render the detachable attachment of the second needle plate. Four pieces of L-shaped (in side view) hooks are integrally provided on the underside of the second needle plate; more specifically, on the left and right portions respectively of the longitudinal ends of the underside. On the other hand, four recesses are provided for accommodating the aforementioned hooks; three on the sewing machine bed and one on the underside of the first needle plate. Also, a positioning notch for lateral positioning is formed on the right rear-end portion of the second needle plate, and a protrusion for engagement with the notch is provided on the right front-end portion of the first needle plate. Also a small (few mm) space is defined between the front end of the second needle plate and an opening of the sewing machine bed.

Thus, upon attachment of the second needle plate, the second needle plate is fitted from above to an opening portion defined on the sewing machine bed 1 and slightly (few mm) pushed toward the rear. Thus the elasticity of the four hooks engages themselves with each recess. Also, upon removing the second needle plate, the second needle plate is slightly (few mm) pulled toward the front so as to be disengaged, and thereafter lifted upward.

In such sewing machine, by removing the second needle plate from the sewing machine bed, the upper surface of the sewing machine bed reveals an L-shaped opening and exposes therein a horizontal hook mechanism. Thus, cleaning and trouble shooting work such as removing the bobbin thread tangled to the horizontal hook can be carried out. As compared to the case in which the entire needle plate is removed, the open space created on the sewing machine bed is minimized, thereby preventing the intrusion of dust and foreign objects to the possible extent. Also, the needle hole and the square hole are no longer displaced upon removing the needle plate.

However, under the above described needle plate construction, since the second needle plate made of synthetic resin is engaged with the needle plate and the sewing machine bed by the elasticity of the second needle plate itself, the operational burden incurred by the second needle plate upon attachment/detachment thereof causes the transformation of the hooks. Also, the location of the second needle plate attached to the sewing machine bed with respect to the location of the first needle plate fixed to the sewing machine frame is prone to vary, therefore causing some degree of rattle in the mating surfaces of the first and the second needle plates.

One of the solutions to the above problem is manufacturing the second needle plate also from metal and detachably attaching the second needle plate to the first needle plate with a fastening screw. However, this requires tightening and loosening of the screw upon attachment/detachment of the second needle plate, consequently requiring tools therefor, and complicating the attachment/detachment work.

SUMMARY

Therefore an object of the present disclosure is to provide a needle plate including a first needle plate fixed to a sewing machine bed and a second needle plate detachably attached to the first needle plate, wherein the attachment/detachment of the second needle plate can be easily carried out while preventing the transformation thereof caused by the operational burden of the attachment/detachment operation and further reducing the rattle at the mating surfaces of the first and the second needle plates.

The needle plate of the present disclosure includes a first needle plate provided on a sewing machine bed and having a needle hole through which a sewing needle can be penetrated and a square hole through which a feed dog for feeding a process cloth is projected and retracted. The needle plate also includes a second needle plate arranged in front of the first needle plate and above a horizontal hook mechanism and which is attached detachably to the first needle plate. The needle plate is further provided with an engagement mechanism in which the second needle plate is slid into engagement with the first needle plate and a disengagement mechanism for disengagement of the engagement mechanism.

By sliding the second needle plate to the first needle plate, the second needle plate becomes engaged with the first needle plate, consequently rendering the attachment of the second needle plate. The second needle plate can be removed from the first needle plate by disengagement of the engagement mechanism by the disengagement mechanism and sliding the second needle plate in a direction opposing the above direction. At this point, the detachment/attachment of the second needle plate from the first needle plate can be easily carried out by sliding the second needle plate.

It is preferable for the first needle plate to be made of metal to tolerate the striking of the sewing needle thereto. Also, the second needle plate may, but not limited to, be made of synthetic resin or metal. It is preferable for the second needle plate to be made of metal to secure strength.

Also, various sliding directions such as lateral or longitudinal directions can be adopted for the sliding of the second needle plate. With regard to operability, it is preferable to slide the second needle plate from front to rear direction to render the engagement with the first needle plate.

In the present disclosure, the engagement mechanism is constituted by an engaged portion provided on the first needle plate and an a thin-plate elastic member having a base end thereof fixed to the second needle plate and a free end thereof provided with an engagement portion engagable with the engaged portion. Such engagement mechanism allows a construction in which the engagement portion is engaged with the engaged portion by the elasticity of the thin-plate elastic member.

Since the force generated upon attaching/detaching the second needle plate to/from the first needle plate is absorbed by an elastic transformation of the elastic member, the transformation of the second needle plate itself can be prevented. By providing the engagement portion in the thin-plate elastic member, the engagement mechanism can be realized with a simple construction in addition to reducing the height of the engagement mechanism. Such construction prevents the engagement mechanism from interfering with the parts for the horizontal hook mechanism or the like residing below the needle plate.

At this point, if the positioning of the engaged portion or the engagement portion is arranged to be adjustable, differences in dimensions of parts can be absorbed.

In the present disclosure, by providing the disengagement mechanism with an operation member capable of pressing the elastic member in a direction resisting the elasticity thereof; the engagement between the engaged portion and the engagement portion can be disengaged. Also, the engagement mechanism can be simplified.

By providing an anti-bend stopper for regulating the amount of bend of the elastic member, excessive bending of the elastic member can be prevented.

By providing the disengagement mechanism to the second needle plate, the second needle plate can be slid while carrying out the disengagement operation, thereby simplifying the removal of the second needle plate.

The engagement mechanism may be provided in a location corresponding to the lateral ends of the first needle plate, thus reducing the rattle of the first and the second needle plates upon attachment of the second needle plate.

The engagement of the engaged portion and the engagement portion may be rendered by mutually engaging a recess or an aperture or a protrusion provided on the engaged portion and the engagement portion. Thus, reliable engagement is attained.

BRIEF DESCRIPTION OF THE DRAWINGS

Other objects, features and advantages of the present disclosure will become clear upon reviewing the following description of the illustrative aspect with reference to the accompanying drawings, in which.

DETAILED DESCRIPTION OF THE PREFERRED EMBODIMENT

At least one of a plurality of embodiments of the present disclosure will be described with reference to the drawings.

Figure 1:
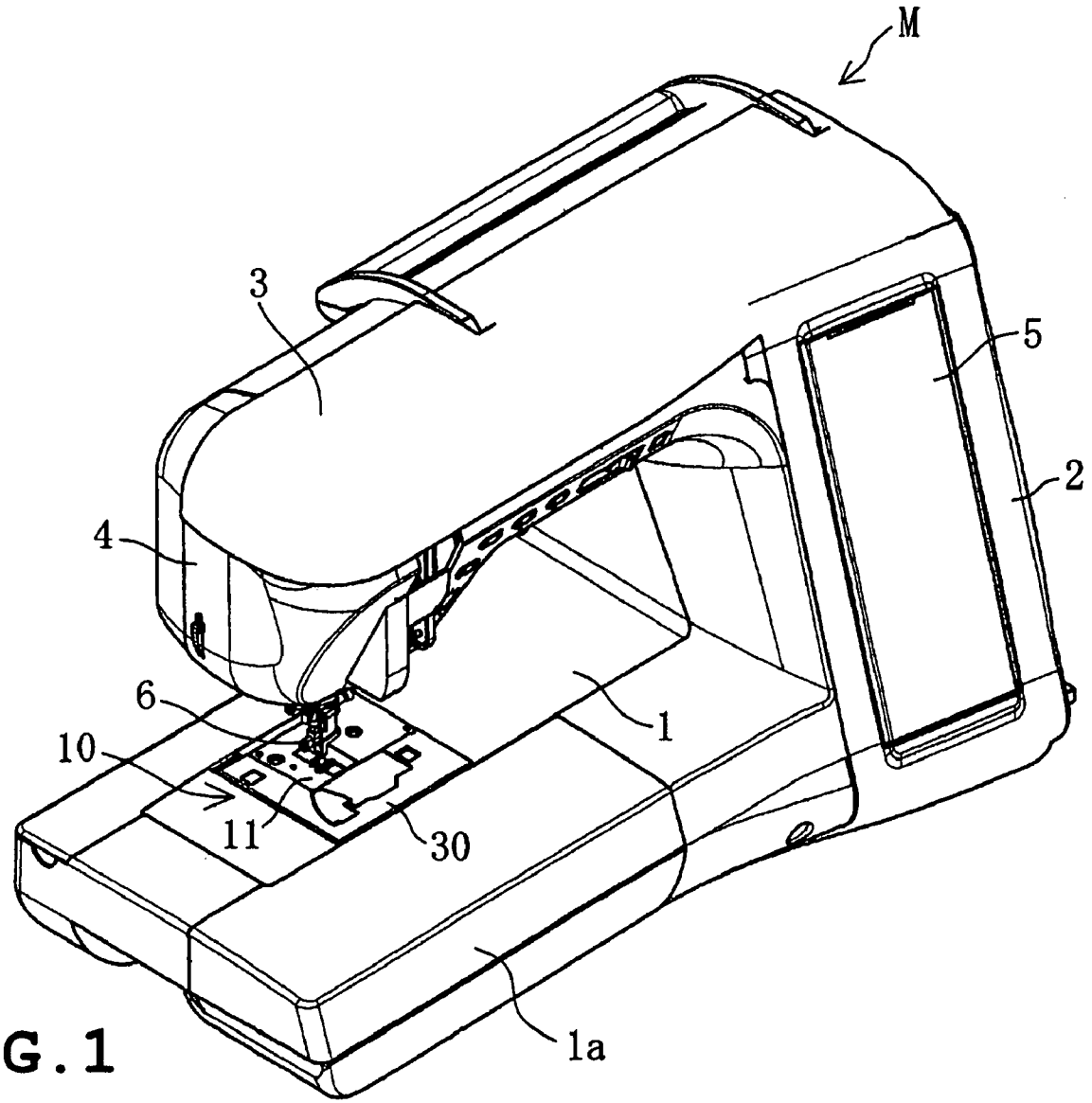
FIG. 1 is a perspective view of the external appearance of a sewing machine illustrating one illustrative aspect of the present disclosure.

FIG. 1 shows an external appearance of a household sewing machine M according the present embodiment. The sewing machine M has a laterally elongated sewing machine bed 1, a pillar 2 extending upright from the right side of the sewing machine bed 1, and an arm 3 extending leftward from the upper portion of the pillar 2. A head 4 is provided on the left end of the arm 3.

A vertically oriented liquid crystal display 5 is provided on the front surface of the pillar 2. A needle bar (not shown) to which a sewing needle 6 is attached is provided in the underside of the head 4. A needle bar vertically moving mechanism (not shown) vertically moving the needle bar, a thread take-up drive mechanism (not shown) driving the thread take-up in synchronization with the vertical movement of the needle bar, and the like are provided inside the arm 3.

The sewing machine bed 1 has a removable auxiliary table 1*a* in the left front portion thereof. A needle plate 10 according to the present embodiment is provided on the upper surface of the sewing machine bed 1. The details of the needle plate 10 will be described later. Though not shown, a horizontal hook mechanism known in the art is located below the needle plate 10 inside the sewing machine bed 1. The horizontal hook mechanism includes an outer hook having a tip, a non-rotatable inner hook provided inside the outer hook and a drive mechanism, or the like, rotating the outer hook in synchronization with the vertical movement of the needle bar. A bobbin is detachably set to the inner hook.

Also, though not shown, a cloth feed mechanism including a feed dog for feeding a cloth and a feed dog drive mechanism longitudinally and vertically driving the feed dog in synchronization with the vertical movement of the needle bar is provided inside the sewing machine bed 1.

Figure 2:
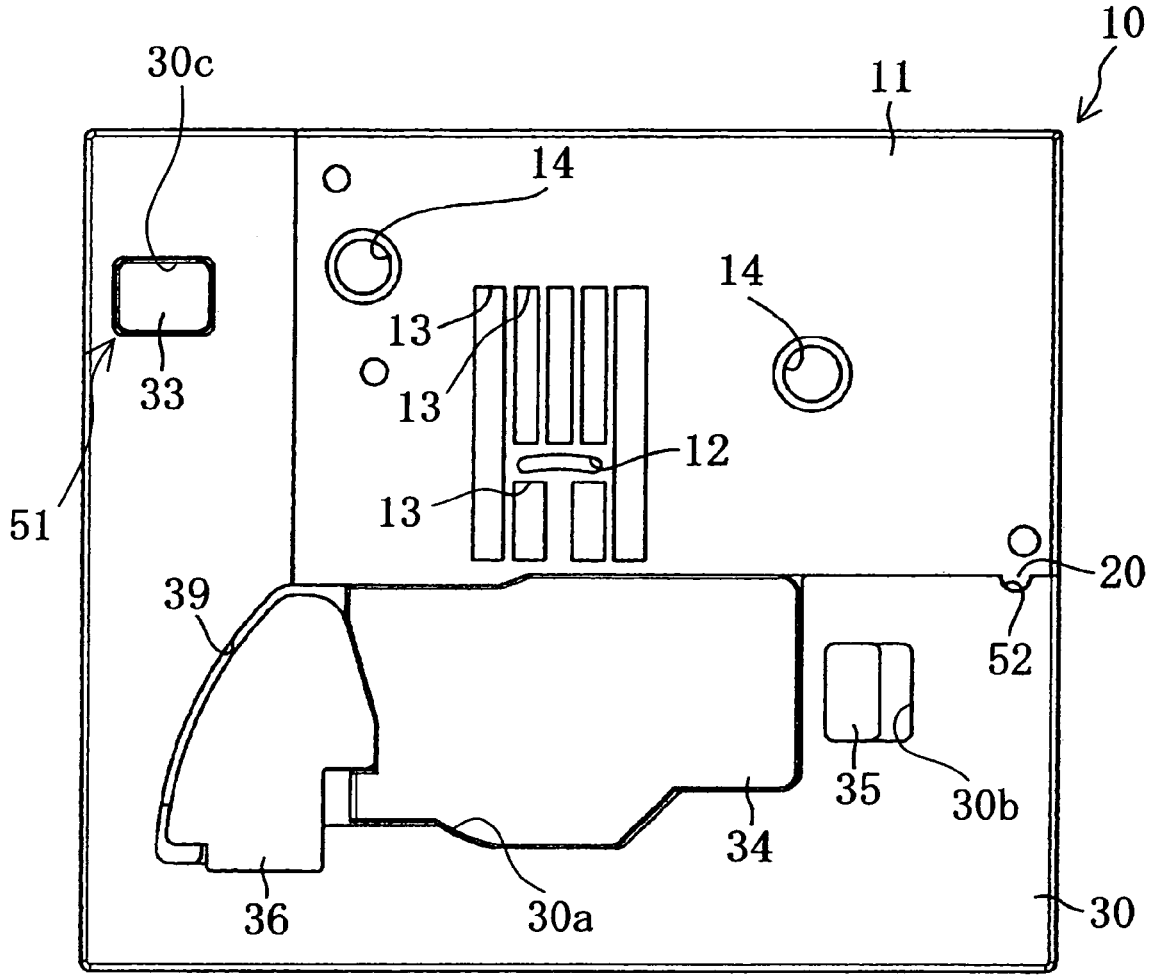
FIG. 2 is a plan view of a needle plate.
Figure 3:
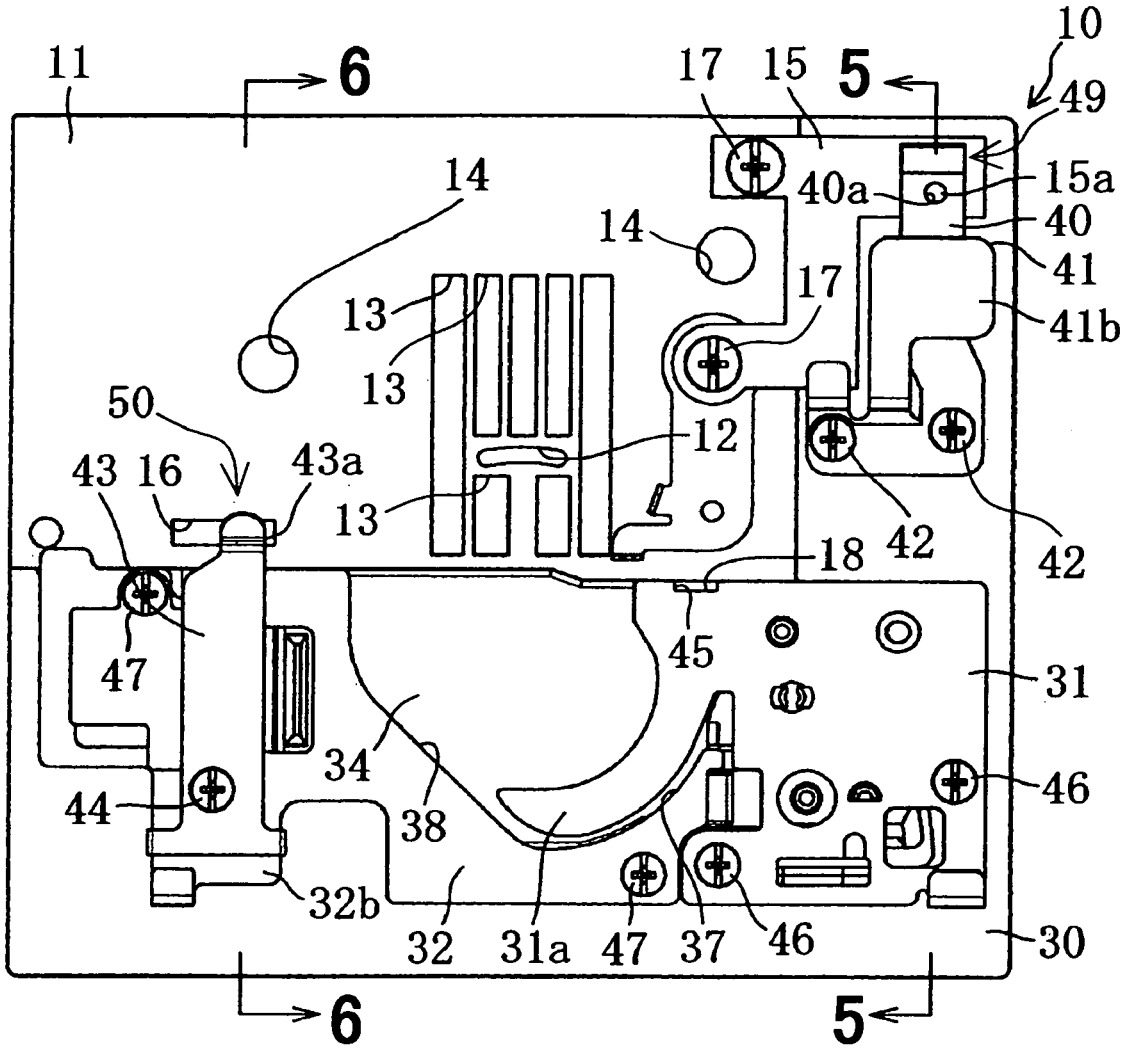
FIG. 3 is a bottom view of the needle plate.
Figure 4:
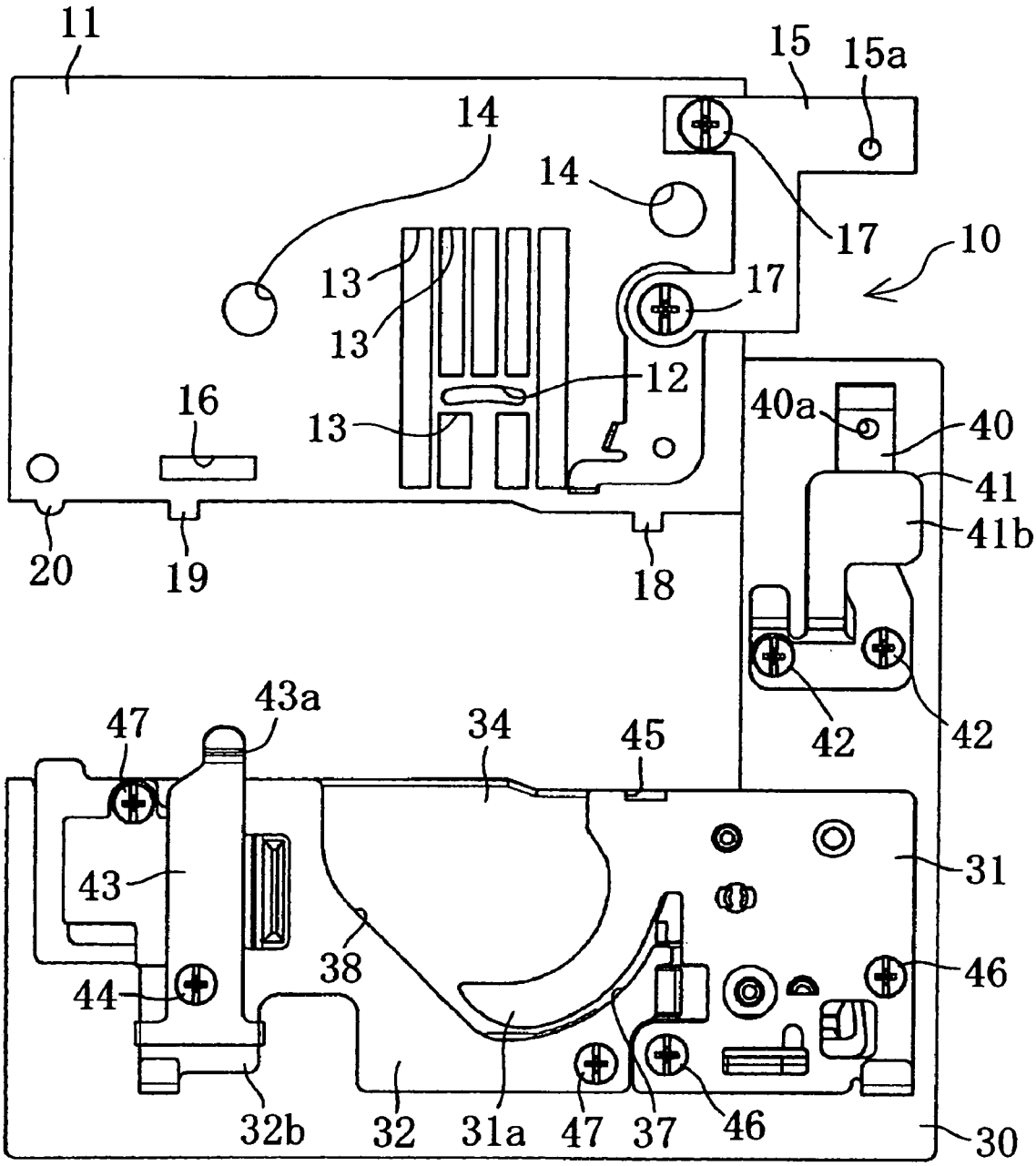
FIG. 4 is a partial bottom view of the needle plate.

The needle plate 10 according to the present embodiment will be described in detail with reference to FIGS. 2 to 6. As shown in FIGS. 2 to 4, the needle plate 10, the entirety of which is in an oblong plate-form, is provided so as to cover an upper surface opening of the sewing machine bed 1. FIG. 2 is a plan view of the needle plate 10. FIGS. 3 and 4 illustrate the underside of the needle plate 10 which is the reverse side of FIG. 2, in which the left and right are the opposite of FIG. 2.

The needle plate 10 includes a first needle plate 11 fixed to the sewing machine bed 1 and a second needle plate 30 detachably attached to the first needle plate 11. The needle plate 10 is constructed by mating the first and the second needle plates 11 and 30. In the present embodiment, the second needle plate 30 is engaged (attached) with the first needle plate 11 by sliding the second needle plate 30 from front (the lower side in FIG. 2) to rear (the upper side in FIG. 2) with respect to the first needle plate 10.

As shown in FIGS. 2 to 4, the first needle plate 11 is made of a metal material (for example a steel plate) formed in a laterally elongated oblong plate-form. A needle hole 12 in a substantially oval form elongated in the lateral direction and through which a sewing needle 6 can be penetrated is formed on the first needle plate 11 and below the sewing needle 6. Also, a plurality of (seven) square holes 13 in a linear form elongated in the longitudinal direction are provided in the front and rear and to the left and right of the needle hole 12. The feed dog moves in the front and rear direction while projecting and retracting from the square holes 13. In FIG. 2, penetrating holes 14 are defined in two locations; the central-right portion and the rear-left end portion of the first needle plate 11. The first needle plate 11 is fixed to the frame of the sewing machine bed 1 by inserting screws (not shown) respectively to the penetrating holes 14.

As shown in FIGS. 3 and 4, an engagement receiving member 15 made of metal plate is provided on the underside of the first needle plate 11, more specifically, on the rear portion of the left edge (the right side in FIGS. 3 and 4). The engagement receiving member 15 is made of metal plate in a reversed L-shape, and fixed to the first needle plate 11 by a screw 17 so as to protrude to the left from the left edge of the first needle plate 11. A protrusion 15*a* is provided on the left end underside of the engagement receiving member 15.

Also, on the underside of the first needle plate 11, a laterally elongated recess 16 is formed in the right front end portion (left side in FIGS. 2 and 3). As will be described later, the protrusion 15*a* and the recess 16 function as engaged portions. On the front edge of the first needle plate 11, three engagement protrusions 18, 19 and 20 are provided in a forwardly protruding manner.

Next, the second needle plate 30 will be described. As shown in FIGS. 2 to 4, the second needle plate 30 is made of a metal plate (for example, a steel plate) formed in a substantially L-shape in entirety and located along the left and the front edge of the first needle plate 11. As shown in FIG. 2, an opening 30*a* for bobbin replacement is formed in the front (above the inner hook of the horizontal hook mechanism) of the needle hole 12 and the square hole 13 of the second needle plate 30. Also, a transparent needle plate lid 34 made of synthetic resin openably covering the opening 30*a* is provided on the second needle plate 30. The needle plate lid 34 is coplanar with the second needle plate 30.

A covering lid 36 is provided on the upper surface of the second needle plate 30 and in the left side of the needle plate lid 34. The cover lid 36 is coplanar with the second needle plate 30. A vertically penetrating second guide groove 39 is formed between the second needle plate 30 and the curved left edge of the cover lid 36. Also, though not shown, a cutting blade for cutting the bobbin thread is mounted on the underside of the cover lid 36, more specifically, on the terminating end (front end) of the second guide groove 39.

Figure 6:
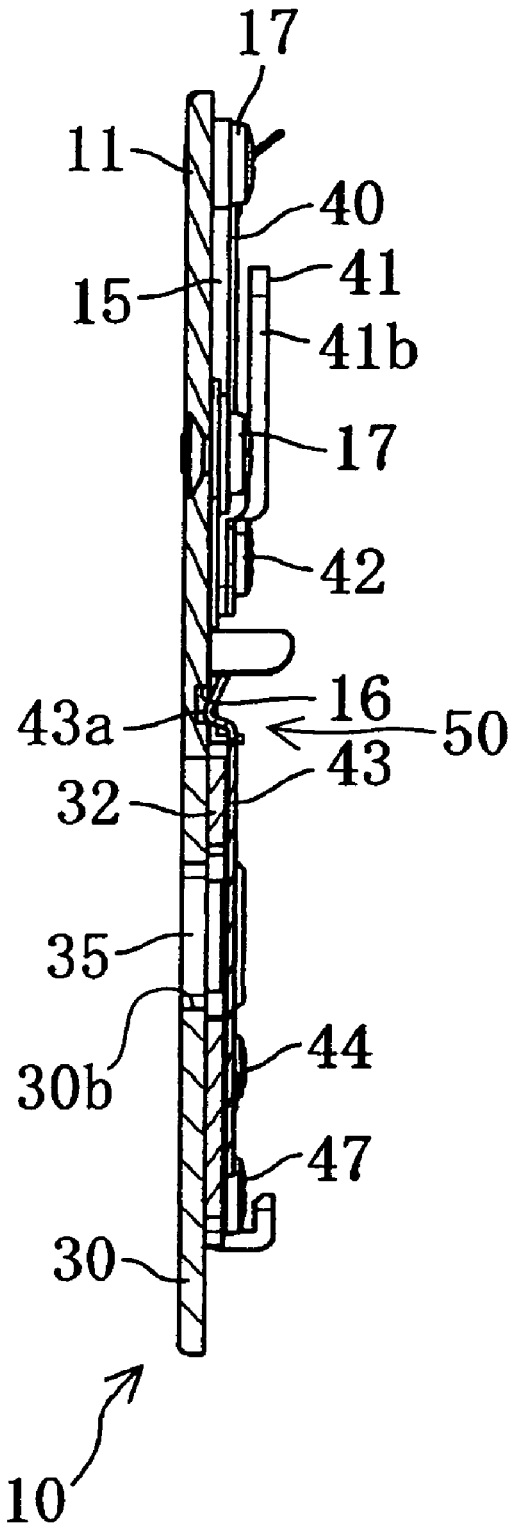
FIG. 6 is a vertical section view taken along line 6—6 in FIG. 3.

Also, an oblong opening 30*b* is formed on the right side of opening 30*a* of the second needle plate 30. As also shown in FIG. 6, a lock member 35 is provided on the underside of the second needle plate 30, and an operation tab therefor is arranged slidably in the lateral direction inside the oblong opening 30*b*. The needle plate lid 34 is locked in a closed state when the lock member 35 is positioned in the left inside the oblong opening 30*b* as shown in FIG. 2. The needle plate lid 34 can be released (removed) by rightwardly sliding the lock member 35 inside the oblong opening 30*b*.

Figure 5:
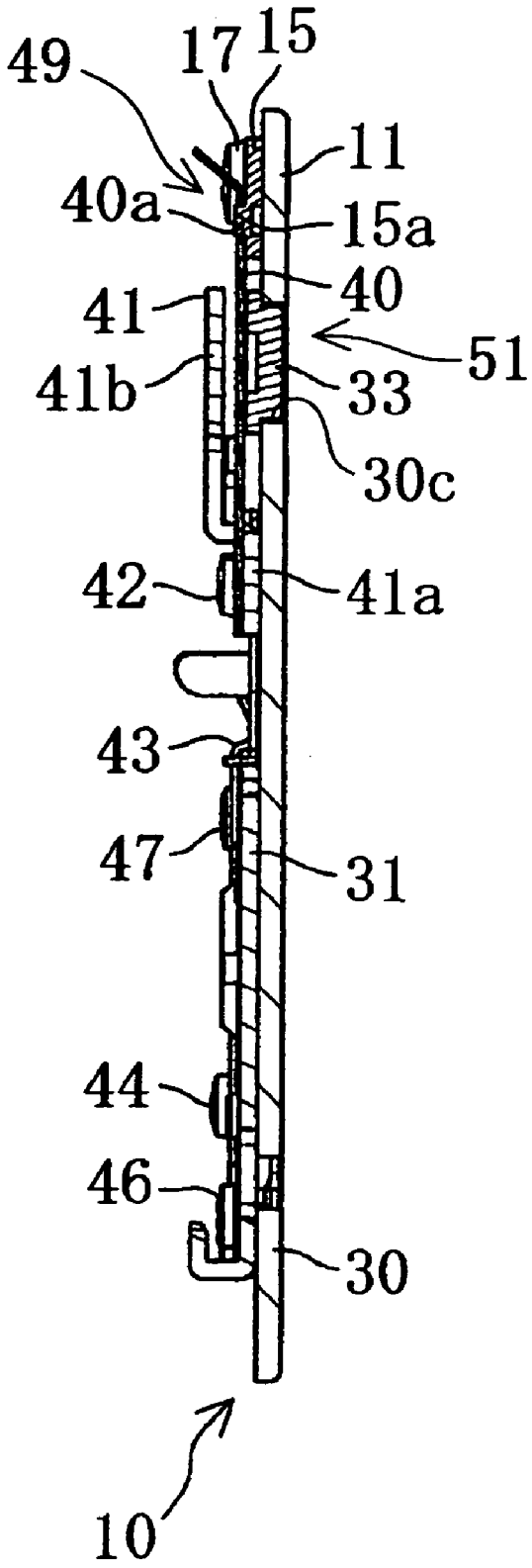
FIG. 5 is a vertical section view taken along line 5—5 in FIG. 3.

An oblong opening 30*c* is formed on the rear end portion of the left edge of the second needle plate 30. As shown in FIG. 5, a disengagement button 33 serving as an operation member is pressably arranged in the oblong opening 30*c* from the underside. As will be described later, the disengagement button 33 is a component of a later described disengagement mechanism. The operation tab of the lock member 35 and the upper surface of the disengagement button 33 are positioned substantially in the same height as the upper surface of the second needle plate 30.

Also, an engagement recess 52, engagement recess (not shown) and engagement recess 45 (refer to FIGS. 3 and 4) engaging with engagement protrusions 20, 19 and 18 respectively are integrally provided in the rear edge of the second needle plate 30, that is, the portion that is mated with the front edge of the first needle plate 11. The forgoing arrangement enables the positioning of the second needle plate 30 upon attachment thereof to the first needle plate 11.

As opposed to this, as shown in FIGS. 3 and 4, a first bobbin thread guide plate 31 is fixed on the left (right side in the figures) front side of the underside of the second needle plate 30 by two screws 46. A second bobbin thread guide plate 32 is fixed by two screws 47 in the right side (left side in the figures) A bobbin passage 38 continuing to the opening 30*a* is defined between the first bobbin thread guide plate 31 and the second bobbin thread guide plate 32. The bobbin can be attached/detached through the bobbin passage 38.

A thread guide portion 31*a* in a substantially crescent form for leftwardly guiding the bobbin thread drawn from the bobbin is integrally provided on the right end of the first bobbin thread guide plate 31. The thread guide portion 31*a* is positioned in a location lowered from the upper surface of the second needle plate 30 by the amount of vertical thickness of the needle plate lid 34 and a first guide groove 37 in a circumferential shape is formed between the thread guide portion 31*a* and the second bobbin thread guide plate 32 in front of the thread guide portion 31*a*. The terminating end (rear end) of the first guide groove 37 is continued to the starting end (rear end) of a second guide groove 39.

Thus, attachment/detachment (replacement) of the bobbin to/from the horizontal hook mechanism can be carried out through the bobbin passage 38 with the needle plate lid 34 removed from the second needle plate 30. Upon attaching a new bobbin, by introducing the bobbin thread drawn from the bobbin into the first and the second guide grooves 37 and 39 sequentially as to hook the bobbin thread onto the thread guide portion 31*a* and finally cutting the bobbin thread by the cutting blade, the bobbin thread is properly set and appropriate length of thread can be drawn from the bobbin.

As shown in FIGS. 3 to 6, an engagement member 40 serving as the elastic member composed of a plate spring formed in a thin plate and a regulating member 41 functioning as an anti-bend stopper are provided on the underside of the second needle plate 30, more specifically, on the underside of the rear left-end portion thereof. The front ends of the engagement member 40 and the regulating member 41 are placed atop one another and fixed to the second needle plate 30 by two screws 42.

The engagement member 40 is formed in a substantially L-shape when viewed from above. The free end of the rear end portion of the engagement member 40 is bent in the lower oblique direction. An aperture 40*a* serving as an engagement portion is formed in a location which is slightly in front of the bent portion of the engagement member 40 and corresponding to the protrusion 15*a* of the engagement receiving member 15. The aperture 40*a* engages with the protrusion 15*a* by the elasticity of the engagement member 40 upon attaching the second needle plate 30 to the first needle plate 11. Thus, the protrusion 15*a* of the engagement receiving member 15 and the aperture 40*a* of the engagement member 40 constitute the first engagement mechanism 49 (refer to FIGS. 3 and 5).

Also, as shown in FIG. 5, the underside of the disengagement button 33 contacts the upper surface of the engagement member 40, in a portion slightly in front of the aperture 40*a*. Thus, when the disengagement button 33 is pressed downward, the engagement portion 40 is bent downward consequently disengaging the aperture 40*a* and the protrusion 15*a*.

The regulating member 41 has a mounting portion 41*a* (refer to FIG. 5) on the front end thereof. The rear end of the mounting portion 41*a* is formed in a lowered step defining a regulating portion 41*b* serving as an anti-bend stopper. The mounting portion 41*a* being placed between the engagement member 40 and the underside of the second needle plate 30 is attached with a screw 42. The regulating portion 41*b* is arranged on the underside of the engagement member 40, in a portion corresponding to the disengagement button 33, slightly spaced apart from the engagement member 40. Thus, the bending of the engagement member 40 upon pressing the disengagement button 33 is regulated by the regulating portion 41*b*. The disengagement button 33, engagement member 40 and the regulating member 41 constitute the disengagement mechanism 51.

On the other hand, as shown in FIGS. 3, 4 and 6, an engagement member 43 serving as an elastic member made of plate spring is provided near the right end of the second bobbin thread guide plate 43. The engagement member 43 is formed in a thin plate elongated in the longitudinal direction, the front end thereof having a longer lateral length than the plate spring mounting portion 32*b*. The lateral ends of the engagement member 43 are bent in the upward direction so as to hold the plate spring mounting portion 32*b* from the left and right side. The base end (front end) of the engagement member 43 is mounted on the plate spring mounting member 32*b* of the second bobbin thread guide plate 32 by a screw 44. At this point, thought not shown, an aperture through which the screw 44 of the engagement member 43 is passed is formed in a longitudinally elongate hole and the mounting position of the engagement member 43 is longitudinally adjustable.

A protrusion 43*a* serving as an engagement portion bent in a substantially V-shape in side view is provided on the free end of the rear end portion of the engagement member 43. The protrusion 43*a* is engaged with a recess 16 of the first needle plate 11 by the elasticity of the engagement member 43 upon attaching the second needle plate 30 to the first needle plate 11. Thus, the protrusion 43*a* of the engagement member 43 and the recess 16 of the first needle plate 11 constitute the second engagement mechanism 50 (refer to FIGS. 3 and 6). By forwardly pulling the second needle plate 30, the protrusion 43*a* and the recess 16 are disengaged.

Next, the operation and effect of the above constructed needle plate 10 will be described herein after.

As described above, the needle plate 10 includes a first needle plate 11 fixed to the sewing machine bed 1 and a second needle plate 30 detachably attached to the first needle plate 11. When the second needle plate 30 is detached, the upper surface (front and the left side portion) of the sewing machine bed 1 reveals an L-shaped opening so as to expose the horizontal hook mechanism. Thus, the user is able to easily clean the horizontal hook and carry out trouble shooting work such as removal of the bobbin thread tangled to the horizontal hook.

At this point, as compared to removing the entire needle plate 10, the opening on the sewing machine 1 bed is minimized, preventing intrusion of dust and foreign objects to the possible extent. Also, the needle hole 12 and the square hole 13 are not displaced by the attachment/detachment of the needle plate 10. The replacement of the bobbin can be carried out by merely removing the needle plate lid 34 without detaching the second needle plate 30.

The attachment/detachment of the second needle plate 30 to/from the first needle plate 11 is carried out as follows. In case of attaching the second needle plate 30, the user slides the second needle plate 30 from front to rear to the first needle plate 11. Then, in the left side of the second needle plate 30, the distal end of the engagement member 40 is inserted to the underside of the engagement receiving member 15 of the first needle plate 11, and the aperture 40*a* of the engagement member 40 is elastically engaged with the protrusion 15*a* of the engagement receiving member 15. Similarly, in the right side of the second needle plate 30, the distal end of the engagement member 43 is inserted to the underside of the first needle plate 11, elastically engaging the protrusion 43*a* to the recess 16.

Also, at this point, the engagement recess 45, the engagement recess not shown, and the engagement recess 52 of the second needle plate 30 are respectively engaged with the engagement protrusions 18, 19 and 20 of the first needle plate 11. Thus, the second needle plate 30 is attached to the first needle plate 11 with a reliable longitudinal and lateral positioning. No unnecessary spaces are formed in the mating portion of the first and second needle plates 11 and 30, or between the second needle plate 30 and the edge of the opening of the sewing machine bed 1. Also, since second needle plate 30 is engaged with the first needle plate 11 by the engagement mechanisms 49 and 50 located in the lateral portions thereof, secure attachment is rendered without rattle or displacement.

On the other hand, in case of removing the second needle plate 30 from the first needle plate 11, the user presses the disengagement button 33 and slides the second needle plate 30 so as to pull the second needle plate 30 toward the front side while maintaining the pressure on the disengagement button 33. The pressure applied on the disengagement button 33 downwardly bends the central portion of the engagement member 40 and disengages the aperture 40*a* and the protrusion 15*a*. In such state, by pulling the second needle plate 30 toward the front side, the protrusion 43*a* and the, recess 16 are also disengaged, thereby removing the second needle plate 30 from the first needle plate 11.

When the disengagement button 33 is pressed, the bend of engagement member 40 is regulated by the regulating portion 41*b*. Also, upon attachment/detachment of the second needle plate 30 to/from the first needle plate 11, the needle plate lid 34 may be removed by rightwardly sliding the lock member 35. Thus, since the attachment/detachment of the second needle plate 30 can be carried out by hooking one's finger(s) on the bobbin passage 38, attachment/detachment of the second needle plate 30 can be carried out with more ease. Furthermore, since the mounting position of the engagement member 43 is adjustable in the longitudinal direction, even in case longitudinal dimensions of the protrusion 43*a* of the engagement member 43 and the recess 16 differ, such difference can be absorbed by the adjustability of the engagement member 43.

Thus the needle plate 10 according to the present embodiment includes a first needle plate 11 fixed to the sewing machine bed 1 and a second needle plate 30 detachably attached to the first needle plate 11. The second needle plate 30 is detachably attached to the first needle plate 11 by sliding the second needle plate 30 in the front-rear direction with respect to the first needle plate 11. Thus, screw fastening work and tools therefor are not required, thereby simplifying the attachment/detachment of the second needle plate 30.

At this point, the engagement mechanisms 49 and 50 are constructed by engagement members 40 and 43 respectively composed of plate springs formed as thin plates, wherein the engagement is realized by utilizing the elasticity of the engagement members 40 and 43. Thus, the force applied to the first needle plate 11 upon attachment/detachment of the second needle plate 30 can be absorbed by the elastic transformation of the engagement members 40 and 43 composed of plate springs. Hence, transformation of the second needle plate 30 itself can be prevented. Particularly, according to the present embodiment, since the second needle plate 30 is also made of metal, substantial strength is provided to the second needle plate 30.

Also, by providing the aperture 40*a* and the protrusion 43*a* respectively to the engagement members 40 and 43 composed of plate springs, the engagement mechanisms 49 and 50 can be realized with a simple structure. Additionally, since the height of the engagement mechanisms 49 and 50 can be reduced, the engagement mechanisms 49 and 50 do not interfere with the parts of the horizontal hook mechanism, or the like. Moreover, since the engagement mechanisms 49 and 50 are provided in the positions corresponding to the lateral ends of the first needle plate 11, the second needle plate 30 is engaged with the lateral end portions of the first needle plate 11, thereby preventing the rattle upon attachment of the second needle plate 30.

Yet, furthermore, since the disengagement mechanism 51 provided with the disengagement button 33 that applies pressure resisting the elasticity of the engagement member 40 is provided on the second needle plate 30 side, the user is able to press the disengagement button 33 and pull the second needle plate 30 toward the front with one hand. Thus, the second needle plate 30 can be easily detached from the first needle plate 11.

Next, partial modifications of the above described embodiment will be described herein after.

In the above embodiment, in alternative to providing the recess 16 to the right end of the first needle plate 11 and providing the engagement member 43 to the second needle plate 30, the engagement receiving member 15 having the protrusion 15*a* may be provided on the underside of the right end of the first needle plate 11 and the engagement member 40 having the aperture 40*a* engaging with the protrusion 15*a* may be provided on the second needle plate 30. In such case, the disengagement button 33 can be additionally provided in the right end of the second needle plate 30. Also, the engagement members 40 and 43 may be provided on the first needle plate 11, and the engagement receiving member 15 and the recess 16 may be provided on the second needle plate 30.

On the underside of the second needle plate 30, in alternative to the engagement members 40 and 43, engagement members in a thin plate form may be respectively arranged upright in the vertical direction, and engaged walls having recess portions (engaged portion) that engage with the distal ends (engagement portions) of the engagement members may be provided on the first needle plate 11. As described above, engagement mechanisms having various engagement functions may be used for the engagement mechanism of the first and the second needle plates 11 and 30.

In the above embodiment, the second needle plate 30 is slid in the front-rear direction; however the second needle plate may be slid in the left-right direction. Also, the second needle plate 30 may be made of synthetic resin.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

We claim:

1. A needle plate for a sewing machine placed on a sewing machine bed having a horizontal hook mechanism therein, the needle plate comprising:

a first needle plate fixed to the sewing machine bed and having a needle hole through which a sewing needle is penetratable and a square hole through which a feed dog for feeding a workpiece cloth is projected and retracted;

a second needle plate positioned in front of the first needle plate and above the horizontal hook mechanism and detachably attached to the first needle plate;

an engagement mechanism in which the second needle plate is slid into engagement with the first needle plate, the engagement mechanism being provided with an engaged portion provided on the first needle plate, a thin-plate elastic member having a base end fixed to the second needle plate and a free end having an engagement portion engageable with the engaged portion, wherein the engaged portion and the engagement portion are engaged by an elastic force of the thin-plate elastic member; and a disengagement mechanism for disengagement of the engagement mechanism, the disengagement mechanism being provided with an operation member capable of pressing the elastic member in a direction resisting the elastic force thereof, wherein the engaged portion and the engagement portion are disengaged by pressing the operation member.

2. The needle plate according to claim 1, wherein the engagement mechanism engages the second needle plate with the first needle plate by sliding the second needle plate from front to rear.

3. The needle plate according to claim 1, wherein a positioning of the engaged portion or the engagement portion is adjustable.

4. The needle plate according to claim 1, wherein the disengagement mechanism further comprises an anti-bend stopper for regulating a bending amount of the elastic member.

5. The needle plate according to claim 1, wherein the disengagement mechanism is provided in the second needle plate.

6. The needle plate according to claim 1, wherein the engagement mechanism is provided in a position corresponding to lateral ends of the first needle plate.

7. The needle plate according to claim 1, wherein the engagement of the engaged portion and the engagement portion are rendered by mutual engagement of a recess or an aperture or a protrusion provided in the engaged portion and the engagement portion.

8. A needle plate for a sewing machine placed on a sewing machine bed having a horizontal hook mechanism therein, the needle plate comprising:

a first needle plate fixed to the sewing machine bed and having a needle hole through which a sewing needle is penetratable and a square hole through which a feed dog for feeding a workpiece cloth is projected and retracted;

a second needle plate positioned in front of the first needle plate and above the horizontal hook mechanism and detachably attached to the first needle plate;

an engagement mechanism in which the second needle plate is slid into engagement with the first needle plate, the engagement mechanism being provided with an engaged portion provided on the first needle plate, a thin-plate elastic member having a base end fixed to the second needle plate and a free end having an engagement portion engageable with the engaged portion, wherein the engaged portion and the engagement portion are engaged by an elastic force of the thin-plate elastic member, the engagement of the engaged portion and the engagement portion are rendered by mutual engagement of a recess or an aperture or a protrusion provided in the engaged portion and the engagement portion; and a disengagement mechanism for disengagement of the engagement mechanism.

9. The needle plate according to claim 8, wherein the disengagement mechanism further comprises an anti-bend stopper for regulating a bending amount of the elastic member.

10. The needle plate according to claim 8, wherein the disengagement mechanism is provided in the second needle plate.

11. The needle plate according to claim 8, wherein the engagement mechanism is provided in a position corresponding to lateral ends of the first needle plate.

* * * * *